US009637304B2

(12) United States Patent
Tseng

(10) Patent No.: US 9,637,304 B2
(45) Date of Patent: May 2, 2017

(54) BICYCLE HELMET PACKAGING BOX

(71) Applicant: GIANT MANUFACTURING CO., LTD., Taichung (TW)

(72) Inventor: Jian-Lin Tseng, Taichung (TW)

(73) Assignee: GIANT MANUFACTURING CO., LTD., Taichung (TW)

( * ) Notice: Subject to any disclaimer, the term of this patent is extended or adjusted under 35 U.S.C. 154(b) by 0 days.

(21) Appl. No.: 14/581,856

(22) Filed: Dec. 23, 2014

(65) Prior Publication Data

US 2016/0101926 A1 Apr. 14, 2016

(30) Foreign Application Priority Data

Oct. 14, 2014 (TW) ..... 103135521 A

(51) Int. Cl.

| | |
|---|---|
| ***A45C 11/02*** | (2006.01) |
| ***B65D 85/18*** | (2006.01) |
| ***B65D 21/02*** | (2006.01) |
| ***B65D 5/38*** | (2006.01) |
| ***B65D 5/50*** | (2006.01) |
| *B65D 5/42* | (2006.01) |

(52) U.S. Cl.

CPC ..... *B65D 85/18* (2013.01); *B65D 5/38* (2013.01); *B65D 5/5038* (2013.01); *B65D 21/0212* (2013.01); *B65D 5/4204* (2013.01)

(58) Field of Classification Search

CPC . A45C 3/12; B65D 5/50; B65D 5/001; B65D 5/4608

USPC ..... 206/8, 278; 229/918

See application file for complete search history.

(56) References Cited

U.S. PATENT DOCUMENTS

| | | | | | |
|---|---|---|---|---|---|
| 616,426 | A * | 12/1898 | Schoenleber | ..... | A45C 11/02 206/8 |
| 1,256,437 | A * | 2/1918 | Carlega | ..... | A45C 11/02 206/8 |
| 2,343,128 | A * | 2/1944 | Anderson | ..... | A45C 11/02 206/8 |
| 3,587,836 | A * | 6/1971 | Brown | ..... | A45C 11/00 206/8 |

(Continued)

FOREIGN PATENT DOCUMENTS

| | | | | |
|---|---|---|---|---|
| DE | 4023526 A1 * | 1/1992 | ..... | B65D 5/6605 |
| ES | EP 1880949 A1 * | 1/2008 | ..... | B65D 5/001 |
| TW | 255369 | 8/1995 | | |

*Primary Examiner* — Sue A Weaver

(74) *Attorney, Agent, or Firm* — Muncy, Geissler, Olds & Lowe, P.C.

(57) ABSTRACT

A bicycle helmet packaging box includes a box body including a top wall, a bottom wall and a peripheral wall connected between the top wall and the bottom wall, and an accommodation chamber surrounded by the peripheral wall for accommodating a bicycle helmet in an upright position with a top portion thereof facing toward the top wall. The box body defines an imaginary axis that extends substantially perpendicular to the top wall and the bottom wall. The peripheral wall includes a door panel turnable about the imaginary axis. The box body has a side opening selectively closable by the door panel and adapted for the passing of the bicycle helmet to access to the accommodation chamber. The user can conveniently take the bicycle helmet out of the bicycle helmet packaging box, or put it back to the inside of the bicycle helmet packaging box.

7 Claims, 5 Drawing Sheets

(56) References Cited

U.S. PATENT DOCUMENTS

| | | | | | |
|---|---|---|---|---|---|
| 4,660,725 | A * | 4/1987 | Fishman | A47B 87/02 | 206/278 |
| 4,881,637 | A * | 11/1989 | Peters | A45C 3/12 | 206/278 |
| 5,584,430 | A * | 12/1996 | Mulry | B65D 5/543 | 229/117.13 |
| 6,732,858 | B1 * | 5/2004 | Chang Ou | A47B 87/0276 | 206/278 |
| 2008/0289974 | A1 * | 11/2008 | McClore | A45C 11/02 | 206/8 |
| 2009/0057174 | A1 * | 3/2009 | Cesario, Jr. | B65D 15/22 | 206/278 |

* cited by examiner

BICYCLE HELMET PACKAGING BOX

BACKGROUND OF THE INVENTION

1. Field of the Invention

The present invention relates to bicycle helmet technology and more particularly, to a bicycle helmet packaging box for accommodating a bicycle helmet.

2. Description of the Related Art

Commercial bicycle helmets are provided in a respective individual packaging box at the factory for delivery and display at the sales outlet. Taiwan Patent 255369 discloses a bicycle helmet packaging box that has an exhibition window located in a curved area at the top portion thereof. When purchasing a bicycle helmet, the consumer can view the style, color, etc. of the bicycle helmet through the exhibition window, and the salesman can pick up the bicycle helmet with the bicycle helmet packaging box and then take the bicycle helmet out of the bicycle helmet packaging box and hand it to the consumer for trial.

This purchase procedure is very inconvenient. More particularly, when the salesman picks one selected bicycle helmet packaging box from a stack of bicycle helmet packaging boxes, this action is likely to mess up the neat stack of bicycle helmet packaging boxes. Further, if the consumer does not want to buy the bicycle helmet after a trial, the salesman will be difficult to put the bicycle helmet with its packaging box back to its original position. Further, the formation of the exhibition window greatly weakens the structural strength of the bicycle helmet packaging box, therefore, the bicycle helmet packaging box tends to sag in its top wall and to become unsightly when it is stacked up with other bicycle helmet packaging boxes. Further, conventional bicycle helmet packaging boxes do not provide a grip, and therefore they are not convenient for pickup. Although the aforesaid patented bicycle helmet packaging box provides a grip, however, because the grip protrudes over the sidewall of the bicycle helmet packaging box, it occupies much space and tends to interfere with other packaging boxes, bringing inconvenience to users.

SUMMARY OF THE INVENTION

The present invention has been accomplished under the circumstances in view. It is the main object of the present invention to provide a bicycle helmet packaging box, which allows the user to conveniently take the bicycle helmet out of the bicycle helmet packaging box, or put it back to the inside of the bicycle helmet packaging box.

To achieve this and other objects of the present invention, the invention provides a bicycle helmet packaging box for accommodating a bicycle helmet that has a top portion corresponding to the top of the user's head. The bicycle helmet packaging box comprises a box body having a top wall, a bottom wall and a peripheral wall connected between the top wall and the bottom wall, and an accommodation chamber surrounded by the peripheral wall for accommodating the bicycle helmet in an upright position with the top portion facing toward the top wall. The box body defines an imaginary axis that extends substantially perpendicular to the top wall and the bottom wall. The peripheral wall comprises a door panel that can be turned about the imaginary axis. The box body further comprises a side opening selectively closable by the door panel and adapted for the passing of the bicycle helmet to access to the accommodation chamber.

The bicycle helmet packaging box can be placed on a place with the top wall disposed above the bottom wall, or stacked up with other bicycle helmet packaging boxes in the same positioning manner, enabling the bicycle helmet to be kept in the respective bicycle helmet packaging box in the same condition as being worn on the user's head (with the top portion facing upwards). Thus, the user can directly open the door panel and then take the bicycle helmet out of or put it back in the bicycle helmet packaging box without removing the bicycle helmet packaging box from the storage place or packaging box stack.

Preferably, the bicycle helmet packaging box further comprises a carrier panel for carrying the bicycle helmet. The carrier panel is fixedly mounted at the door panel, and movable with the door panel in and out of the accommodation chamber. Thus, when the user opens the door panel, the carrier panel will be moved with the door panel out of the side opening so that the user can take the bicycle helmet from the carrier panel or put it back onto the carrier panel.

It is another object of the present invention to provide a bicycle helmet packaging box, which provides an exhibition function and has a high structural strength.

To achieve this and other objects of the present invention, the peripheral wall of the aforesaid bicycle helmet packaging box comprises at least one exhibition window spaced from the top wall at a distance. Thus, through the exhibition window, the user can view the style, color, etc. of the bicycle helmet in the bicycle helmet packaging box. Further, because the exhibition window is not extended to the top wall, the design of the exhibition window avoids weakening the structural strength of the bicycle helmet packaging box, so that the bicycle helmet packaging box is less likely to sag or to deform.

Preferably, the door panel of the bicycle helmet packaging box has at least one exhibition window located therein. Because the door panel is normally disposed to face toward the user for allowing the user to open and close it, allocating the exhibition window in the door panel enhances the exhibition function.

It is still another object of the present invention to provide a bicycle helmet packaging box, which provides a grip for convenient use.

To achieve this and other objects of the present invention, the peripheral wall of the aforesaid bicycle helmet packaging box further comprises a hinge, two exhibition windows located at two opposite sides relative to the hinge, and a grip defined by the hinge these two exhibition windows. The grip is provided for gripping by the user to take the bicycle helmet packaging box conveniently. Further, because the grip is a part of the peripheral wall and not made in a protruded condition, it occupies less space and avoids interfering with other packaging boxes, bringing convenience to users.

Preferably, in the aforesaid bicycle helmet packaging box, one of the exhibition windows that constitute the grip is located in the door panel. Thus, the grip is disposed at one lateral side relative to the door panel, and the door panel is normally disposed to face toward the user. Therefore, by means of the grip, the user can conveniently pick up the bicycle helmet packaging box from the storage place or stacked packaging boxes.

Other advantages and features of the present invention will be fully understood by reference to the following specification in conjunction with the accompanying drawings, in which like reference signs denote like components of structure.

DETAILED DESCRIPTION OF THE INVENTION

Figure 1:
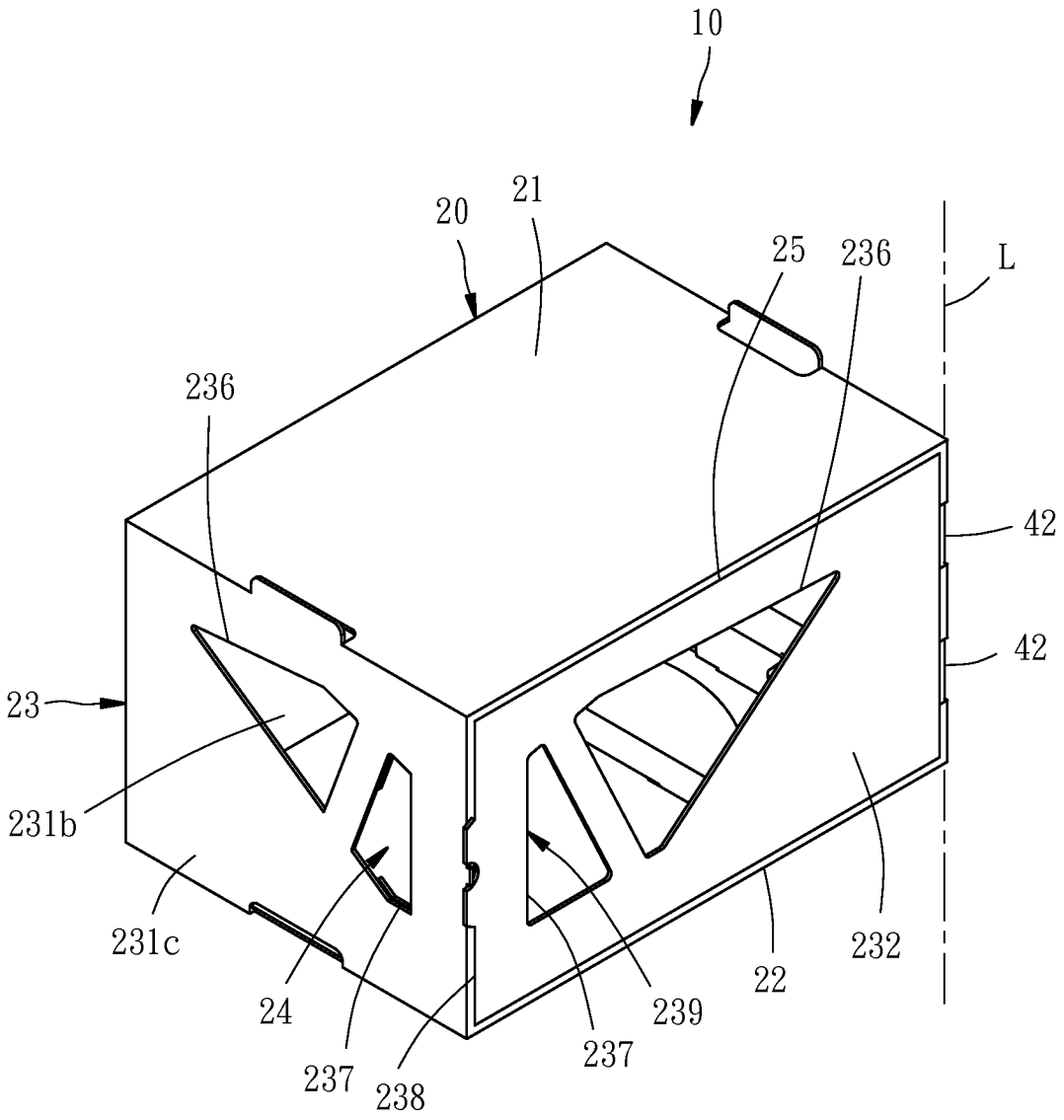
FIG. 1 is an oblique top elevational view of a bicycle helmet packaging box in accordance with the present invention, illustrating a side opening of the bicycle helmet packaging box covered by a door panel.
Figure 2:
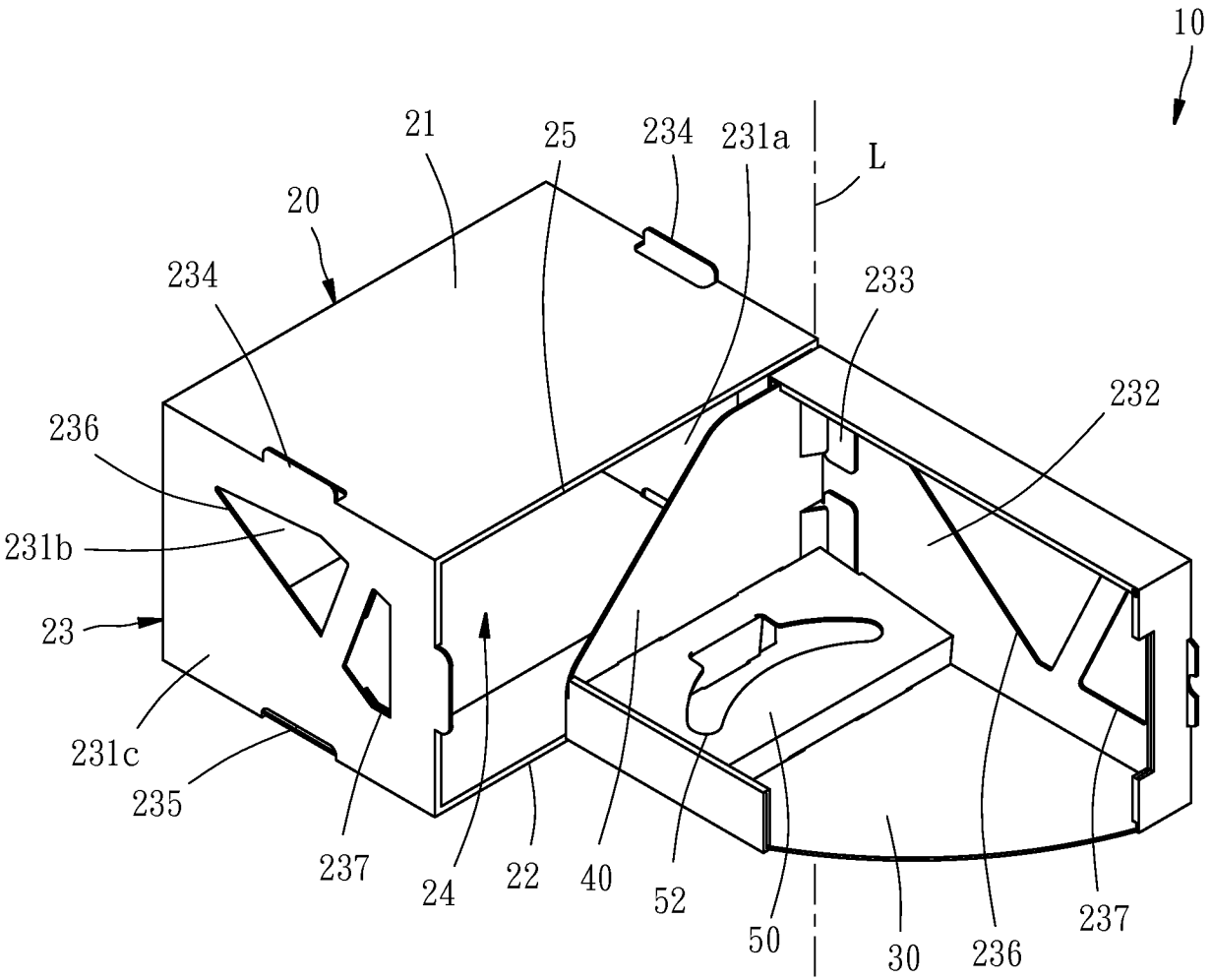
FIG. 2 corresponds to FIG. 1, illustrating the side opening of the bicycle helmet packaging box opened.

Referring to FIGS. 1 and 2, a bicycle helmet packaging box 10 in accordance with the present invention is shown. The bicycle helmet packaging box 10 comprises a box body 20, a carrier panel 30, a baffle panel 40, and a positioning panel 50.

Figure 3:
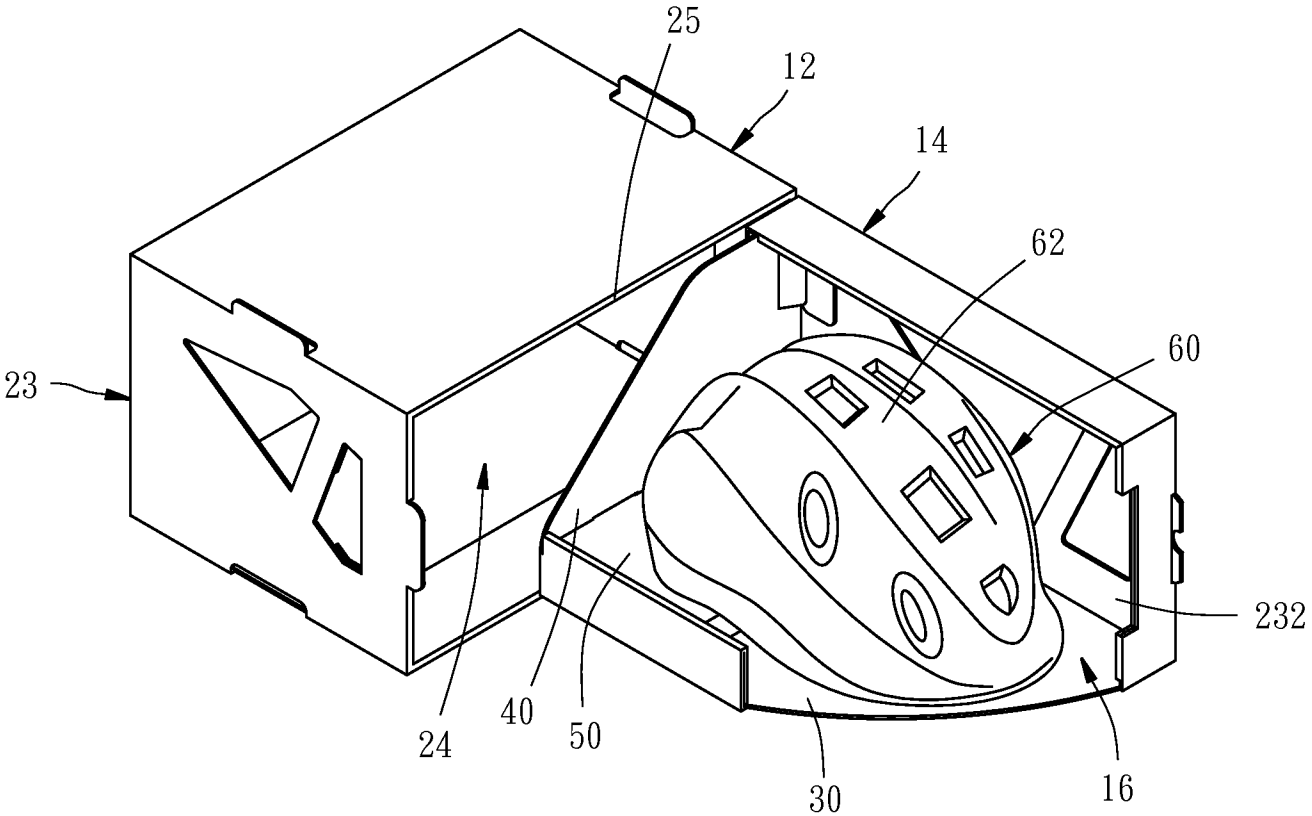
FIG. 3 is similar to FIG. 2, illustrating a bicycle helmet accommodated in the pivoting unit.

The box body 20 can be made in the form of an enclosed container as shown in FIG. 1. Alternatively, the box body 20 can be made in the form of a side-open container as shown in FIG. 2. In the case that the box body 20 is made in the form of an enclosed container, the carrier panel 30, the baffle panel 40 and the positioning panel 50 are positioned inside the box body 20. The bicycle helmet packaging box 10 is adapted to accommodate a bicycle helmet 60 (see FIG. 3). The bicycle helmet 60 has a top portion 62 corresponding to the top of the user's head.

The box body 20 comprises opposing top wall 21 and bottom wall 22, a peripheral wall 23 connected between the top wall 21 and the bottom wall 22, and an accommodation chamber 24 surrounded by the peripheral wall 23 between the top wall 21 and the bottom wall 22 for accommodating the bicycle helmet 60. In this embodiment, the box body 20 is a rectangular container, wherein the peripheral wall 23 is composed of four panels including three side panels, namely, first, second and third side panels 231*a*~*c* fixedly connected between the top wall 21 and the bottom wall 22, and a door panel 232 turnable about an imaginary axis L that substantially extends perpendicular to the top wall 21 and the bottom wall 22. However, the shape of the box body is not limited to a rectangular parallelepiped. Further, the peripheral wall 23 is not limited to the composition of four panels. Any peripheral wall design capable of defining the desired accommodation chamber 24 and having a door panel 232 turnable about the imaginary axis L can be accepted.

Further, the top wall 21, bottom wall 22 and first and third side panels 231*a* and 231*c* of the box body 20 define a side opening 25. The side opening 25 is selectively closed by the door panel 232, i.e., the door panel 232 can be turned about the imaginary axis L so that the user can close the door panel 232 on the side opening 25, as shown in FIG. 1, causing the side opening 25 to be covered by the door panel 232, or alternatively, the user can open the door panel 232 from the side opening 25, leaving the door panel 232 connected to only one lateral side of the side opening 25 so that the bicycle helmet 60 can be put in or moved away from the accommodation chamber 24 through the side opening 25.

The carrier panel 30 is fixedly connected to, for example, but not limited to, the inner surface of the door panel 232 that faces toward the accommodation chamber 24. The carrier panel 30 is adapted for carrying the bicycle helmet 60. When turning the door panel 232, the carrier panel 30 and the loaded bicycle helmet 60 are moved with the door panel 232 into or out of the accommodation chamber 24. The baffle panel 40 can be (but not constrained to be) fixedly connected to the door panel 232 and the carrier panel 30. The door panel 232, the carrier panel 30 and the baffle panel 40 are arranged perpendicular to one another, defining a semi-open receiving trough 16 for holding the bicycle helmet 60 steadily. The positioning panel 50 can be (but not constrained to be) mounted on the carrier panel 30. Further, the positioning panel 50 defines therein an arched positioning slot 52. When the bicycle helmet 60 is placed on the carrier panel 30, a part (head circumference adjustment band) of the bicycle helmet 60 can be inserted into the arched positioning slot 52, enabling the bicycle helmet 60 to be steadily positioned on the carrier panel 30.

Figure 4:
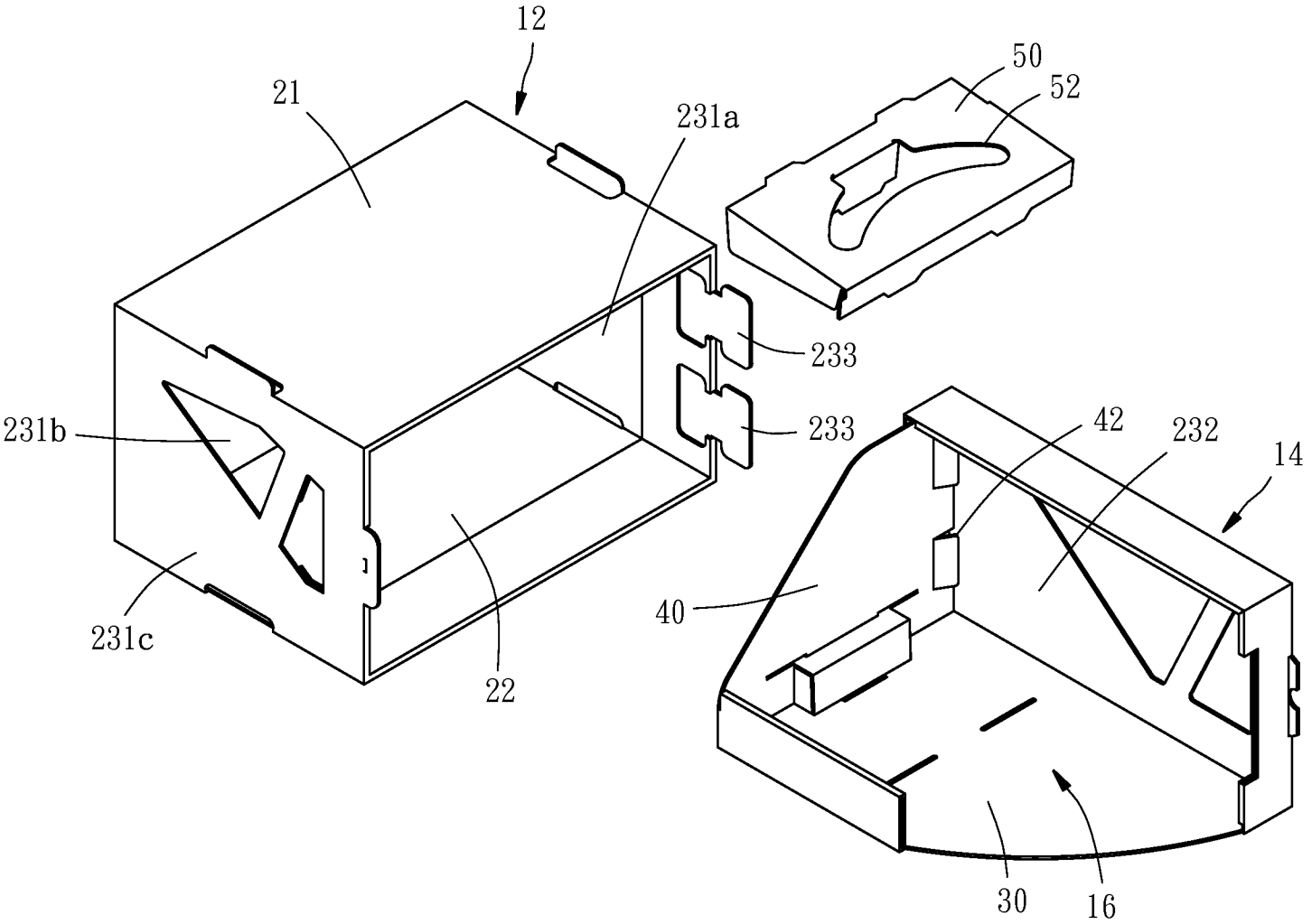
FIG. 4 is an exploded view of the bicycle helmet packaging box in accordance with the present invention.

Referring to FIG. 4, the top wall 21, bottom wall 22 and side panels 231*a*~*c* of the box body 20 are (but not constrained to be) integrally connected together to form an accommodation unit 12. i.e., the accommodation unit 12 is formed of one single piece of cardboard. The door panel 232 can be (but not constrained to be) integrally connected with the carrier panel 30 and the baffle panel 40 to form a pivoting unit 14, i.e., the pivoting unit 14 is formed of one single piece of cardboard. Further, the first side panel 231*a* comprises at least one, for example, two pivot lugs 233 outwardly extended from one side thereof. The baffle panel 40 comprises two coupling holes 42 located in the junction between the baffle panel 40 and the door panel 232. The two pivot lugs 233 are respectively coupled to the two coupling holes 42 to pivotally connect the pivoting unit 14 to the first side panel 231*a*. However, the structure and connection method between the accommodation unit 12 and the pivoting unit 14 are not limited to design in this embodiment.

Figure 5:
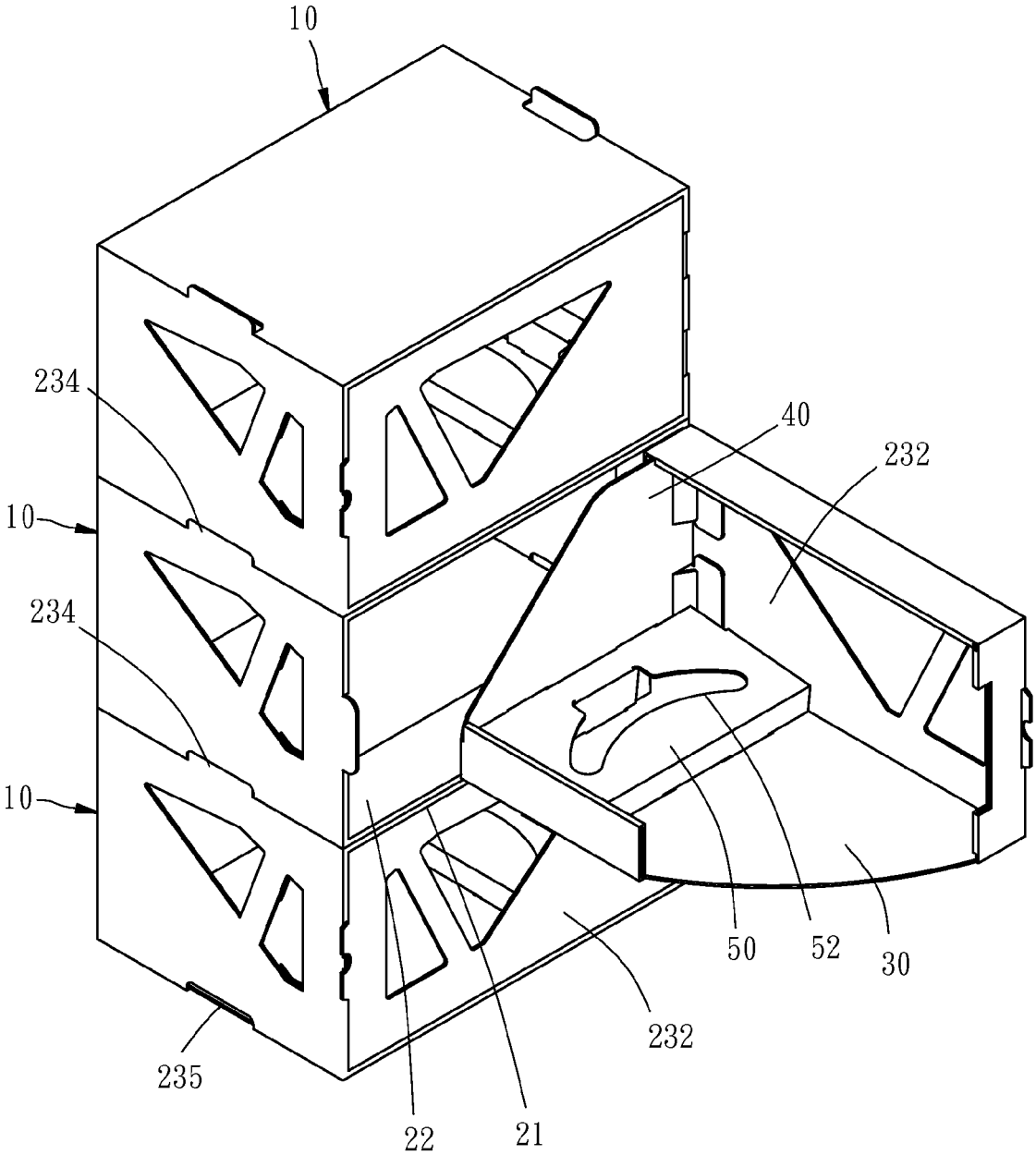
FIG. 5 illustrates three bicycle helmet packaging boxes arranged in a stack in accordance with the present invention.

The bicycle helmet packaging box 10 can be placed on a surface with the top wall 21 disposed above the bottom wall 22, or stacked up with other bicycle helmet packaging boxes 10 in the same positioning manner (see FIG. 5), enabling the bicycle helmet 60 to be kept in the respective bicycle helmet packaging box 10 in the same condition as being worn on the user's head (with the top portion 62 facing upwards). Thus, the user can directly open the door panel 232 and then take the bicycle helmet 60 out of or put it back in the bicycle helmet packaging box 10 without removing the bicycle helmet packaging box 10 from the storage place or stacked packaging boxes. Therefore, the bicycle helmet packaging box 10 allows users to pick and place the bicycle helmet 60. In the present preferred embodiment, the bicycle helmet packaging box 10 has the carrier panel 30 mounted therein. Once the user has opened the door panel 232, the carrier panel 30 will be moved with the door panel 232 out of the side opening 25, allowing the user to pick up the bicycle helmet 60 from the carrier panel 30, or to put the bicycle helmet 60 back onto the carrier panel 30, and thus, this design facilitates ease of use.

The peripheral wall 23 of the bicycle helmet packaging box 10 can be (but not imperatively) configured to provide at least one set of plug portion 234 and plug hole 235. The plug portion 234 and plug hole 235 of one same set are vertically disposed to mate with each other. In this embodiment, the peripheral wall 23 comprises two plug portions 234 respectively upwardly extended from the respective top sides of the first side panel 231*a* and third side panel 231*c* over the top side of the top wall 21 and two plug holes 235 respectively located in the respective bottom sides of the first side panel 231*a* and third side panel 231*c* adjacent to the bottom wall 22. When two bicycle helmet packaging boxes 10 are arranged in a stack, the plug portions 234 of the lower bicycle helmet packaging box 10 are respectively plugged into the plug holes 235 of the upper bicycle helmet packaging box 10. Thus, multiple bicycle helmet packaging boxes 10 can be stacked up and neatly and steadily held in a stack.

The peripheral wall 23 of the bicycle helmet packaging box 10 can be (but not imperatively) configured to provide at least one exhibition window. In this embodiment, a relatively larger exhibition window 236 and a relatively smaller exhibition window 237 are respectively located in the door panel 232 and the third side panel 231*c*. The exhibition windows 236 and 237 are respectively spaced from the top wall 21 at a distance. Thus, the user can visually view the style, color, etc. of the bicycle helmet 60 in the bicycle helmet packaging box 10 through the exhibition windows 236 and 237. Further, because the exhibition windows 236 and 237 are not extended to the top wall 21, this design avoids weakening the structural strength of the bicycle helmet packaging box 10, so that the bicycle helmet packaging box 10 is less likely to sag or to deform.

The door panel 232 normally faces toward the user for allowing the user to easily close or open it, therefore, the exhibition windows 236 and 237 are preferably provided at the door panel 232 to facilitate exhibition of the storage bicycle helmet. Further, the door panel 232 and the third side panel 231*c* form together a hinge 238. The two exhibition windows 237 are respectively disposed at two opposite sides relative to the hinge 238. Further, the hinge 238 and the two exhibition windows 237 form together a grip 239. Thus, the user can insert the fingers into the two exhibition windows 237 to seize the grip 239, thereby taking the bicycle helmet packaging box 10. Further, the grip 239 is a part of the peripheral wall 23 and kept in flush with the surface of the peripheral wall 23, it occupies less space and avoids interfering with other packaging boxes. Further, because one of the exhibition windows 237 is located in the door panel 232, the grip 239 is disposed at one lateral side relative to the door panel 232, and the door panel 232 is normally disposed to face toward the user, by means of the grip 239, the user can conveniently pick up the bicycle helmet packaging box 10 from the storage place or stacked packaging boxes.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A bicycle helmet packaging box for accommodating a bicycle helmet, said bicycle helmet comprising a top portion corresponding to the top of the head of a user, said bicycle helmet packaging box comprising a box body, said box body comprising a top wall, an opposing bottom wall and a peripheral wall connected between said top wall and said bottom wall, and an accommodation chamber surrounded by said peripheral wall between said top wall and said bottom wall for accommodating said bicycle helmet in such a position that said top portion of said bicycle helmet faces toward said top wall, said box body defining an imaginary axis that extends substantially perpendicular to said top wall and said bottom wall, said peripheral wall comprising a door panel turnable about said imaginary axis, said box body further comprising a side opening selectively closable by said door panel and adapted for the passing of said bicycle helmet to access to said accommodation chamber, and said bicycle helmet packaging box further comprising a carrier panel adapted for carrying said bicycle helmet, said carrier panel being fixedly mounted at said door panel and movable with said door panel in and out of said accommodation chamber.

2. The bicycle helmet packaging box as claimed in claim 1, wherein said peripheral wall comprises at least one exhibition window spaced from said top wall at a predetermined distance.

3. The bicycle helmet packaging box as claimed in claim 2, wherein said door panel comprises at least one said exhibition window.

4. The bicycle helmet packaging box as claimed in claim 1, further comprising a baffle panel fixedly connected said door panel and said carrier panel, said door panel, said carrier panel and said baffle panel defining a semi-open receiving trough for accommodating said bicycle helmet.

5. The bicycle helmet packaging box as claimed in claim 4, wherein said carrier panel, said baffle panel and said door panel are integrally connected together to form a pivoting unit comprising a coupling hole located in the junction between said baffle panel and said door panel; said peripheral wall comprises a side panel integrally connected with said top wall and said bottom wall, and a pivot lug extended from said side panel, said pivot lug being coupled to said coupling hole to pivotally connect said pivoting unit to said side panel.

6. The bicycle helmet packaging box as claimed in claim 1, further comprising a positioning panel located at said carrier panel, said positioning panel comprising a positioning slot for the positioning slot of a part of said bicycle helmet.

7. The bicycle helmet packaging box as claimed in claim 1, wherein said peripheral wall comprises a plug portion protruding over said top wall, and a plug hole disposed adjacent to said bottom wall for receiving the plug portion of another bicycle helmet packaging box of the same design.

* * * * *